US011312139B2

(12) United States Patent
Matsushita

(10) Patent No.: US 11,312,139 B2
(45) Date of Patent: Apr. 26, 2022

(54) METHOD FOR DRIVING LIQUID EJECTING APPARATUS AND LIQUID EJECTING APPARATUS

(71) Applicant: SEIKO EPSON CORPORATION, Tokyo (JP)

(72) Inventor: Junichiro Matsushita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 34 days.

(21) Appl. No.: 16/940,950

(22) Filed: Jul. 28, 2020

(65) Prior Publication Data

US 2021/0031522 A1 Feb. 4, 2021

(30) Foreign Application Priority Data

Jul. 30, 2019 (JP) ..... JP2019-139491

(51) Int. Cl.

| | |
|---|---|
| ***B41J 2/165*** | (2006.01) |
| ***B41J 2/03*** | (2006.01) |
| ***B41J 2/025*** | (2006.01) |
| ***B41J 2/045*** | (2006.01) |

(52) U.S. Cl.

CPC ..... *B41J 2/165* (2013.01); *B41J 2/025* (2013.01); *B41J 2/03* (2013.01); *B41J 2/04581* (2013.01)

(58) Field of Classification Search

None

See application file for complete search history.

(56) References Cited

U.S. PATENT DOCUMENTS

2003/0058302 A1 3/2003 Yonekubo et al.

FOREIGN PATENT DOCUMENTS

| | | |
|---|---|---|
| JP | 2000-117993 | 4/2000 |
| JP | 2004-042314 | 2/2004 |
| JP | 2005-246975 | 9/2005 |
| JP | 2012-096423 | 5/2012 |

*Primary Examiner* — Alejandro Valencia

(74) *Attorney, Agent, or Firm* — Workman Nydegger

(57) ABSTRACT

A method for driving a liquid ejecting apparatus according to a thickening state of liquid in a nozzle determined by a thickening determination section. When the thickening state is a first state, a second flushing signal by which liquid is ejected from a nozzle is supplied a first number of times to the driving element without applying a micro vibration signal by which liquid is not ejected from a nozzle. When the thickening state is a second state in which viscosity of the liquid is higher than viscosity of the liquid in the first state, the second flushing signal that is different from a first flushing signal is supplied the first number of times after applying the micro vibration signal, and a first flushing signal by which liquid is ejected from a nozzle is supplied a second number of times to the driving element after applying the second flushing signals.

8 Claims, 9 Drawing Sheets

FIG. 8

| THICKENING STATE | MICRO VIBRATION PULSE | POWER FLUSHING PULSE | NORMAL FLUSHING PULSE |
|---|---|---|---|
| STATE Qa | NOT SUPPLIED | SUPPLY PULSE M1 TIMES | NOT SUPPLIED |
| STATE Qb | NOT SUPPLIED | SUPPLY PULSE M1 TIMES | SUPPLY PULSE M4 TIMES |
| STATE Qc | NOT SUPPLIED | SUPPLY PULSE M1 TIMES | SUPPLY PULSE M5 TIMES |
| STATE Qd | SUPPLY FIRST MICRO VIBRATION PULSE | SUPPLY PULSE M1 TIMES | SUPPLY PULSE M2 TIMES |
| STATE Qe | SUPPLY SECOND MICRO VIBRATION PULSE | SUPPLY PULSE M1 TIMES | SUPPLY PULSE M3 TIMES |

FIG. 13

| THICKENING STATE | MICRO VIBRATION PULSE | POWER FLUSHING PULSE | NORMAL FLUSHING PULSE |
|---|---|---|---|
| STATE Qa | NOT SUPPLIED | SUPPLY PULSE M1 TIMES | NOT SUPPLIED |
| STATE Qb | NOT SUPPLIED | SUPPLY PULSE M1 TIMES | SUPPLY PULSE M4 TIMES |
| STATE Qc | NOT SUPPLIED | SUPPLY PULSE M1 TIMES | SUPPLY PULSE M5 TIMES |
| STATE Qd' | SUPPLY FIRST MICRO VIBRATION PULSE | SUPPLY PULSE M1 TIMES | SUPPLY PULSE M2' TIMES |
| STATE Qe' | SUPPLY SECOND MICRO VIBRATION PULSE | SUPPLY PULSE M1 TIMES | SUPPLY PULSE M3' TIMES |
| STATE Qf | SUPPLY SECOND MICRO VIBRATION PULSE | SUPPLY PULSE M1 TIMES | SUPPLY PULSE M6 TIMES |

METHOD FOR DRIVING LIQUID EJECTING APPARATUS AND LIQUID EJECTING APPARATUS

The present application is based on, and claims priority from JP Application Serial Number 2019-139491, filed Jul. 30, 2019, the disclosure of which is hereby incorporated by reference herein in its entirety.

BACKGROUND

1. Technical Field

The present disclosure relates to a method for driving a liquid ejecting apparatus and the liquid ejecting apparatus.

2. Related Art

In liquid ejecting apparatuses ejecting liquid, such as ink, to a medium, such as a printing sheet, there arises a problem in viscosity of the liquid caused by evaporation of moisture included in the liquid, for example. JP-A-2000-117993 discloses a liquid ejecting apparatus executing a flushing operation of ejecting liquid having increased viscosity after executing a micro vibration operation of improving a local viscosity state in the vicinity of openings of nozzles by performing micro vibration on the liquid having the increased viscosity.

However, when the general technique described above is used, the liquid having the increased viscosity may not be efficiently ejected. The liquid having the increased viscosity is dispersed in a large range by the micro vibration operation, for example, and therefore, to sufficiently eject the liquid having the increased viscosity, the flushing operation is required to be more frequently performed when compared with an example in which the micro vibration operation is not executed.

SUMMARY

According to an aspect of the present disclosure, a method for driving a liquid ejecting apparatus is provided. The liquid ejecting apparatus includes a liquid ejecting section including a nozzle ejecting liquid, a pressure chamber communicated with the nozzle, and a driving element applying a pressure change to the liquid included in the pressure chamber, a driving signal generation section configured to generate a micro vibration signal which is supplied to the driving element and which applies a pressure change to such an extent that the liquid is not ejected from the nozzle, a first flushing signal which is supplied to the driving element and which applies a pressure change to the liquid included in the pressure chamber to such an extent that the liquid is ejected from the nozzle, and a second flushing signal which is supplied to the driving element and which applies a pressure change to the liquid included in the pressure chamber to such an extent that the liquid is ejected from the nozzle, and a thickening determination section configured to determine a thickening state of the liquid included in the nozzle. The pressure change by the second flushing signal is larger than the pressure change by the first flushing signal. An amount of liquid ejected from the nozzle when the first flushing signal is supplied to the driving element once is larger than an amount of liquid ejected from the nozzle when the second flushing signal is supplied to the driving element once. When the thickening determination section determines that a thickening state of the liquid included in the nozzle is a first state, the micro vibration signal is not supplied to the driving element and the second flushing signal is supplied to the driving element a first number of times. When the thickening determination section determines that the thickening state of the liquid included in the nozzle is a second state in which viscosity of the liquid is higher than viscosity of the liquid in the first state, the micro vibration signal is supplied to the driving element, the second flushing signal is supplied to the driving element the first number of times after the micro vibration signal is supplied, and the first flushing signal is supplied to the driving element a second number of times after the second flushing signal is supplied.

According to another aspect of the present disclosure, a liquid ejecting apparatus includes a liquid ejecting section including a nozzle ejecting liquid, a pressure chamber communicated with the nozzle, and a driving element applying a pressure change to the liquid included in the pressure chamber, a driving signal generation section configured to generate a micro vibration signal which is supplied to the driving element and which applies a pressure change to such an extent that the liquid is not ejected from the nozzle, a first flushing signal which is supplied to the driving element and which applies a pressure change to the liquid included in the pressure chamber to such an extent that the liquid is ejected from the nozzle, and a second flushing signal which is supplied to the driving element and which applies a pressure change to the liquid included in the pressure chamber to such an extent that the liquid is ejected from the nozzle, a driving circuit configured to supply a signal generated by the driving signal generation section to the driving element, and a thickening determination section configured to determine a thickening state of the liquid included in the nozzle. The pressure change by the second flushing signal is larger than the pressure change by the first flushing signal. An amount of liquid ejected from the nozzle when the first flushing signal is supplied to the driving element once is larger than an amount of liquid ejected from the nozzle when the second flushing signal is supplied to the driving element once. When the thickening determination section determines that a thickening state of the liquid included in the nozzle is a first state, the micro vibration signal is not supplied to the driving element and the second flushing signal is supplied to the driving element a first number of times. When the thickening determination section determines that the thickening state of the liquid included in the nozzle is a second state in which viscosity of the liquid is higher than viscosity of the liquid in the first state, the micro vibration signal is supplied to the driving element, the second flushing signal is supplied to the driving element the first number of times after the micro vibration signal is supplied, and the first flushing signal is supplied to the driving element a second number of times after the second flushing signal is supplied.

BRIEF DESCRIPTION OF THE DRAWINGS

FIG. 8 is a diagram illustrating a list of an operation of the liquid ejecting apparatus in accordance with a thickening state.

FIG. 13 is a diagram illustrating a list of operations of a liquid ejecting apparatus in accordance with a thickening state according to the modification.

DESCRIPTION OF EXEMPLARY EMBODIMENTS

Figure 1:
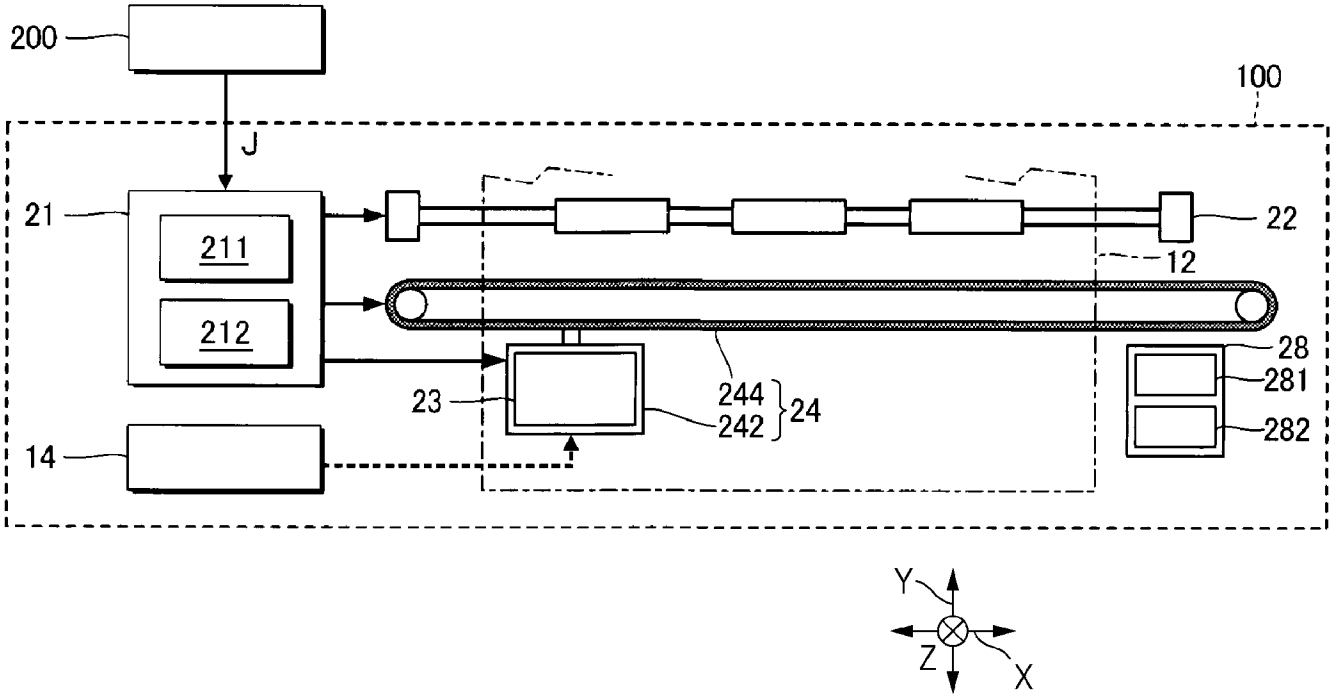
FIG. 1 is a diagram illustrating a partial configuration of a liquid ejecting apparatus according to an embodiment.

Hereinafter, an embodiment of the present disclosure will be described with reference to the accompanying drawings. Note that, in the drawings, sizes and scales of components are appropriately differentiated from actual components. Furthermore, embodiments below are preferred concrete examples of the present disclosure, and therefore, various limitations which are preferable in terms of technique are added to the embodiments. However, the scope of the present disclosure is not limited to the embodiments as long as limitations of the present disclosure is not particularly described hereinafter.

A. EMBODIMENT

FIG. 1 is a diagram illustrating a partial configuration of a liquid ejecting apparatus 100 according to an embodiment. The liquid ejecting apparatus 100 of this embodiment is an ink jet printing apparatus ejecting ink, which is an example of liquid, to a medium 12. The ink is solution including volatile solvent and solute, such as dye or pigment. A typical example of the volatile solvent is water. Although the medium 12 is typically a printing sheet, a print target of arbitrary material, such as a resin film or fabric, is used as the medium 12. The liquid ejecting apparatus 100 includes a liquid container 14. The liquid container 14 stores ink. For example, a cartridge detachable from the liquid ejecting apparatus 100, a pouched ink pack formed by a flexible film, or an ink tank to which ink may be recharged is used as the liquid container 14. An arbitrary number of types of ink may be stored in the liquid container 14.

An external apparatus 200 is connected to the liquid ejecting apparatus 100 in a wired or wireless manner. The external apparatus 200 is an electronic apparatus, for example, processing images of computers, digital still cameras, cellular phones, and the like. The external apparatus 200 successively supplies a print job J to the liquid ejecting apparatus 100. The print job J is an instruction of a series of operations to be performed for printing an image on the medium 12.

As illustrated in FIG. 1, the liquid ejecting apparatus 100 includes a control unit 21, a transport mechanism 22, a liquid ejecting head 23, a moving mechanism 24, and a maintenance mechanism 28. The control unit 21 integrally controls the components included in the liquid ejecting apparatus 100. The print job J is supplied from the external apparatus 200 to the control unit 21. The control unit 21 controls the components included in the liquid ejecting apparatus 100 such that an image specified by the print job J is formed on the medium 12.

The control unit 21 includes a control device 211 and a storage device 212. The control device 211 is a single processor or a plurality of processors which execute various types of calculation and control. Specifically, the control device 211 is configured by at least one type of processor, such as CPU, a GPU, a DSP, or an FPGA. CPU stands for Central Processing Unit. GPU stands for Graphics Processing Unit. DSP stands for Digital Signal Processor. FPGA stands for Field Programmable Gate Array. The storage device 212 is a single memory or a plurality of memories which store programs to be executed by the control device 211 and various data to be used by the control device 211. A recording medium, such as a semiconductor recording medium or a magnetic recording medium, is used as the storage device 212. A combination of a plurality of types of recording media may be used as the storage device 212.

The transport mechanism 22 transports the medium 12 along a Y axis under control of the control unit 21. The moving mechanism 24 causes the liquid ejecting head 23 to reciprocate along an X axis under control of the control unit 21. The X axis intersects with the Y axis, or typically, orthogonally intersects with the Y axis. The moving mechanism 24 includes a transport body 242 of a substantially box shape which accommodates the liquid ejecting head 23 and a transport belt 244 extending in an X direction and having the transport body 242 fixed thereon. The transport body 242 is also referred to as a carriage. Note that the liquid container 14 may be included in the transport body 242 together with the liquid ejecting head 23. In a description below, it is assumed that a Z axis orthogonally intersects with an X-Y plane. One of directions along the Z axis is referred to as a Z1 direction and the other is referred to as a Z2 direction. The Z1 direction corresponds to a direction of gravitational force.

The liquid ejecting head 23 ejects ink supplied from the liquid container 14 to the medium 12 from a plurality of nozzles N under control of the control unit 21. An arbitrary image is formed on a surface of the medium 12 when the liquid ejecting head 23 ejects ink to the medium 12 while the transport mechanism 22 transports the medium 12 and the transport body 242 repeatedly reciprocates.

Figure 2:
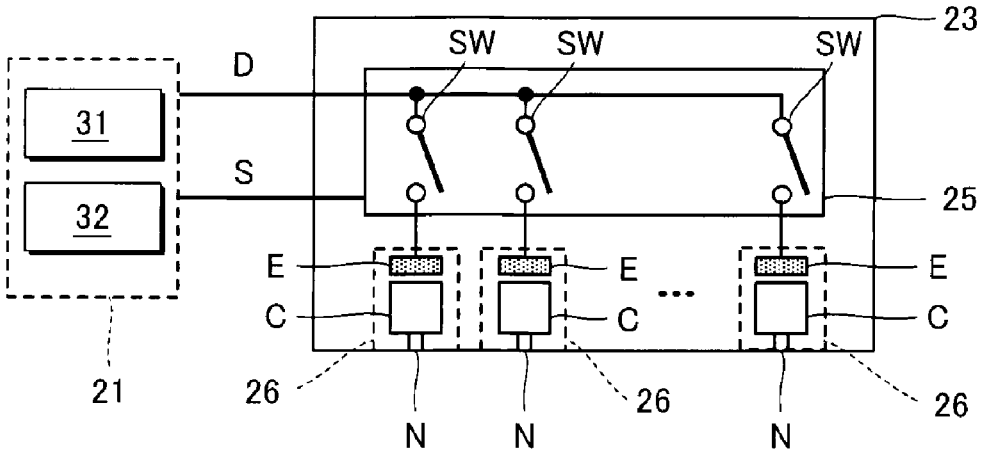
FIG. 2 is a block diagram illustrating functional configurations of a control unit and a liquid ejecting head.

The maintenance mechanism 28 is used to maintain the liquid ejecting head 23. The maintenance mechanism 28 includes a cap 281 and a liquid receiving section 282. The cap 281 is a structure of a substantially box shape having an opening in the Z2 direction. The cap 281 covers an ejection surface including the plurality of nozzles N as illustrated in FIG. 2 so as to seal the plurality of nozzles N. The liquid receiving section 282 is a tank of a substantially box shape having an opening in the Z2 direction. The liquid receiving section 282 is used to receive ink ejected from the nozzles N. Note that the liquid receiving section 282 may be formed as a substantially box shape similarly to the cap 281.

FIG. 2 is a block diagram illustrating functional configurations of the control unit 21 and the liquid ejecting head 23. As illustrated in FIG. 2, the liquid ejecting head 23 includes a driving circuit 25 and a plurality of liquid ejecting sections 26. The liquid ejecting sections 26 eject ink supplied from the liquid container 14 to the medium 12. Each of the plurality of liquid ejecting sections 26 includes a driving element E, a pressure chamber C, and a corresponding one of the nozzles N.

The pressure chamber C is a space communicated with the nozzle N. The plurality of pressure chambers C included in the liquid ejecting head 23 are charged with ink supplied from the liquid container 14. The driving element E changes pressure of the ink included in the pressure chamber C. For example, a piezoelectric element which changes a volume of the pressure chamber C by deforming a wall surface of the pressure chamber C or a heat element which generates bubbles in the pressure chamber C by heating ink included in the pressure chamber C is used as the driving element E. When the driving element E changes pressure of the ink included in the pressure chamber C, the ink included in the pressure chamber C is ejected from the nozzle N. The nozzle N is formed on a nozzle plate 231 illustrated in FIG. 4. A surface of the nozzle plate 231 in the Z1 direction is an ejection surface of the nozzles N.

The control unit 21 supplies a plurality of signals including a control signal S and a driving signal D to the liquid ejecting head 23. The control signal S instructs ejection or non-ejection of ink from the individual nozzles N of the plurality of liquid ejecting sections 26 and ejection amounts. The driving signal D is a voltage signal including a driving pulse in a predetermined cycle. The driving pulse has a waveform for driving the driving element E. Note that the driving signal D may have a waveform including a plurality of driving pulses. Furthermore, a plurality of driving signals D including driving pulses of different waveforms may be used.

The driving circuit 25 drives the individual driving elements E included in the plurality of liquid ejecting sections 26 under control of the control unit 21. The driving circuit 25 includes a plurality of switches SW connected to the respective driving elements E of the liquid ejecting sections 26. Each of the switches SW is configured by a transfer gate which performs switching between supply and stop of the driving signal D to the driving element E in accordance with the control signal S.

As illustrated in FIG. 2, the control unit 21 functions as a driving signal generation section 31 and a thickening determination section 32 when executing a program stored in the storage device 212.

The driving signal generation section 31 generates the driving signal D. The driving signal D generated by the driving signal generation section 31 is supplied to the driving circuit 25 along with the control signal S separately generated.

The thickening determination section 32 estimates thickening states of ink in the plurality of nozzles Z. When a state in which the ink is not ejected from the nozzles N of the liquid ejecting head 23 is continued, viscosity of the ink included in the nozzles N is increased due to evaporation of solvent of the ink.

Figure 3:
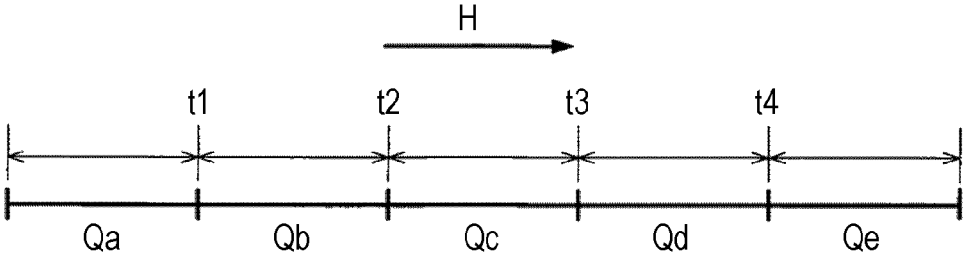
FIG. 3 is a diagram illustrating a thickening state.

FIG. 3 is a diagram illustrating a thickening state. The thickening determination section 32 determines one of a state Qa, a state Qb, a state Qc, a state Qd, and a state Qe as an ink thickening state. The state Qa indicates that a degree of increase in viscosity is low. The state Qc indicates that a degree of increase in viscosity is middle. The state Qb indicates that a degree of increase in viscosity is between the state Qa and the state Qc. The state Qe indicates that a degree of increase in viscosity is high. The state Qd indicates that a degree of increase in viscosity is between the state Qc and the state Qe. The state Qd and the state Qe indicate that viscosity is increased to such an extent that the ink is not ejected from the nozzles N.

Note that the state Qa is an example of a "first state". The state Qd is an example of a "second state". The state Qe is an example of a "third state". The state Qb is an example of a "fourth state". The state Qc is an example of a "fifth state".

For example, the thickening determination section 32 determines an ink thickening state based on a period of time in which a state in which the ink is not ejected from the plurality of nozzles N is continued (hereinafter referred to as an "elapsed time"). When the nozzles N are left for a long period of time without ejecting the ink, the solvent of the ink in the vicinity of menisci MN which are liquid surfaces in the nozzles N gradually volatilized and the viscosity of the ink is increased. The elapsed time indicates a period of time in which the nozzles N are left in a state in which the nozzles N are sealed by the cap 281, for example.

Specifically, the thickening determination section 32 determines that the thickening state is the state Qa when the elapsed time H is smaller than a threshold value t1 as illustrated in FIG. 3. When the elapsed time H is equal to or larger than the threshold value t1 and smaller than a threshold value t2, the thickening determination section 32 determines that the thickening state is the state Qb. The threshold value t2 is larger than the threshold value t1. When the elapsed time H is equal to or larger than the threshold value t2 and smaller than a threshold value t3, the thickening determination section 32 determines that the thickening state is the state Qc. The threshold value t3 is larger than the threshold value t2. When the elapsed time H is equal to or larger than the threshold value t3 and smaller than a threshold value t4, the thickening determination section 32 determines that the thickening state is the state Qd. The threshold value t4 is larger than the threshold value t3. When the elapsed time H is equal to or larger than the threshold value t4, the thickening determination section 32 determines that the thickening state is the state Qe.

When the viscosity of the ink included in the nozzles N is increased, an ejection characteristic, such as a weight or a speed of the ink ejected from the nozzles N, is changed, and therefore, a position of the ink landed on the medium 12 may be shifted from a position to be landed. Quality of an image formed on a surface of the medium 12 is deteriorated due to a difference between the landing positions. To suppress the increase in viscosity of the ink, the liquid ejecting apparatus 100 executes a micro vibration operation and a flushing operation.

Micro vibration is performed on the ink in the micro vibration operation. The micro vibration is small vibration applied to the ink without ejection of the ink from the nozzles N. When ink having increased viscosity (hereinafter referred to as "thickened ink") is stirred with ink which is not thickened by the micro vibration operation so that local increase in viscosity of the ink in the vicinity of the menisci MN included in the nozzles N is reduced. The micro vibration is rephrased by vibration generated in the menisci MN of the ink included in the nozzles Z. Since the ink included in the nozzles N is appropriately stirred by the micro vibration, the local increase in viscosity of the ink in the vicinity of the menisci MN included in the nozzles N is reduced. In the liquid ejecting apparatus 100, the micro vibration operation may be executed in a waiting state in which an ejection surface does not face the medium 12 and a printing state in which the ejection surface faces the medium 12 in plan view from the Z axis.

In the flushing operation, the ink which does not directly contribute to formation of an image is forcibly ejected from the nozzles N by driving the driving elements E. In the flushing operation, pressure for ejecting ink is changed so that the thickened ink is ejected. The flushing operation is executed in the waiting state in which the ejection surface faces the liquid receiving section 282. Specifically, the thickened ink is ejected to the liquid receiving section 282.

The micro vibration operation includes two types of operation, that is, a first micro vibration operation and a second micro vibration operation. Similarly, the flushing operation includes two types of operation, that is, a normal flushing operation and a power flushing operation.

Figure 4:
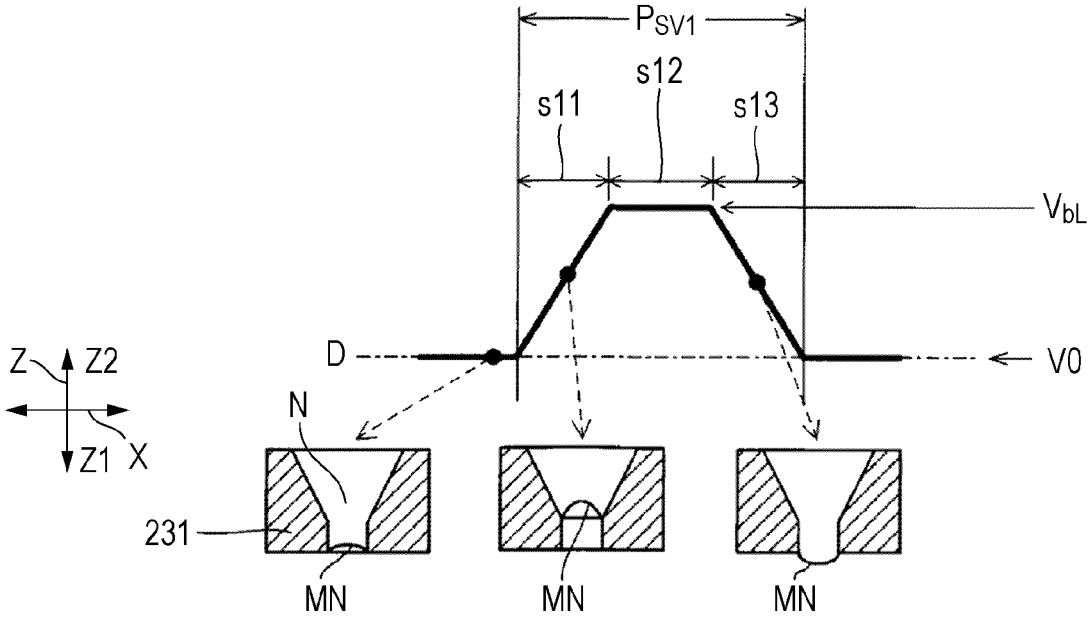
FIG. 4 is a diagram illustrating a first micro vibration pulse and states of a meniscus.
Figure 5:
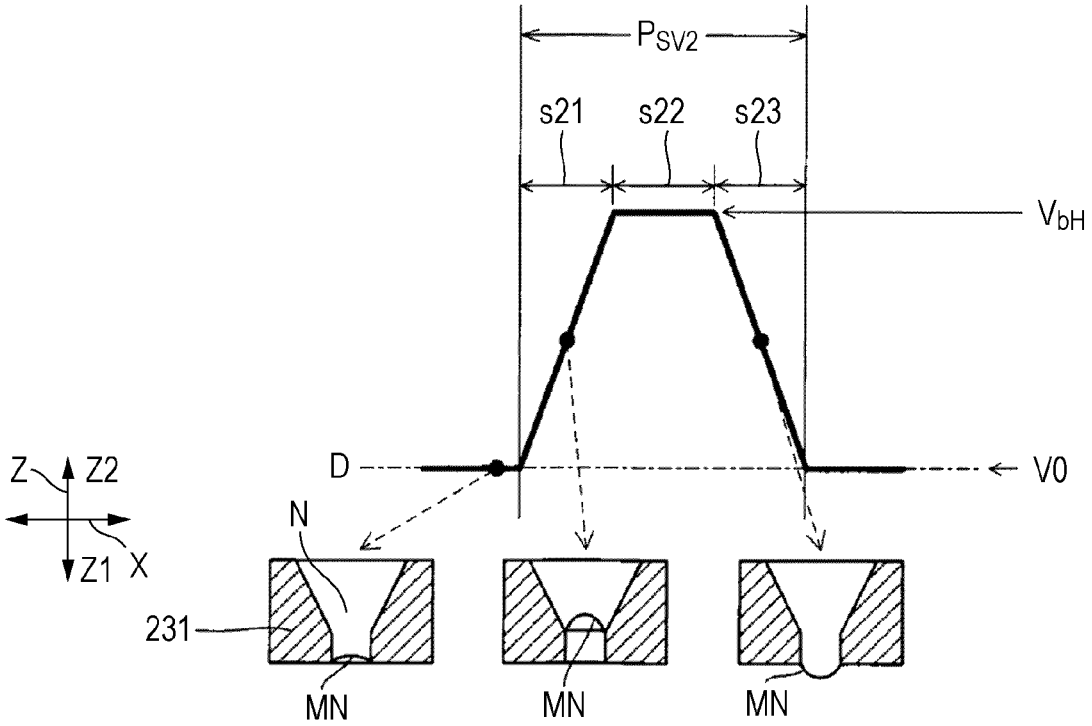
FIG. 5 is a diagram illustrating a second micro vibration pulse and states of a meniscus.

The driving signal generation section 31 generates a driving signal D including a first micro vibration pulse $P_{SV1}$ illustrated in FIG. 4 to execute the first micro vibration operation and generates a driving signal D including a second micro vibration pulse $P_{SV2}$ illustrated in FIG. 5 to execute the second micro vibration operation. The first micro vibration pulse $P_{SV1}$ and the second micro vibration pulse $P_{SV2}$ are examples of the "micro vibration signal". Hereinafter, the first micro vibration pulse $P_{SV1}$ and the second micro vibration pulse $P_{SV2}$ are collectively referred to as a "micro vibration pulse $P_{SV}$" where appropriate.

Figure 6:
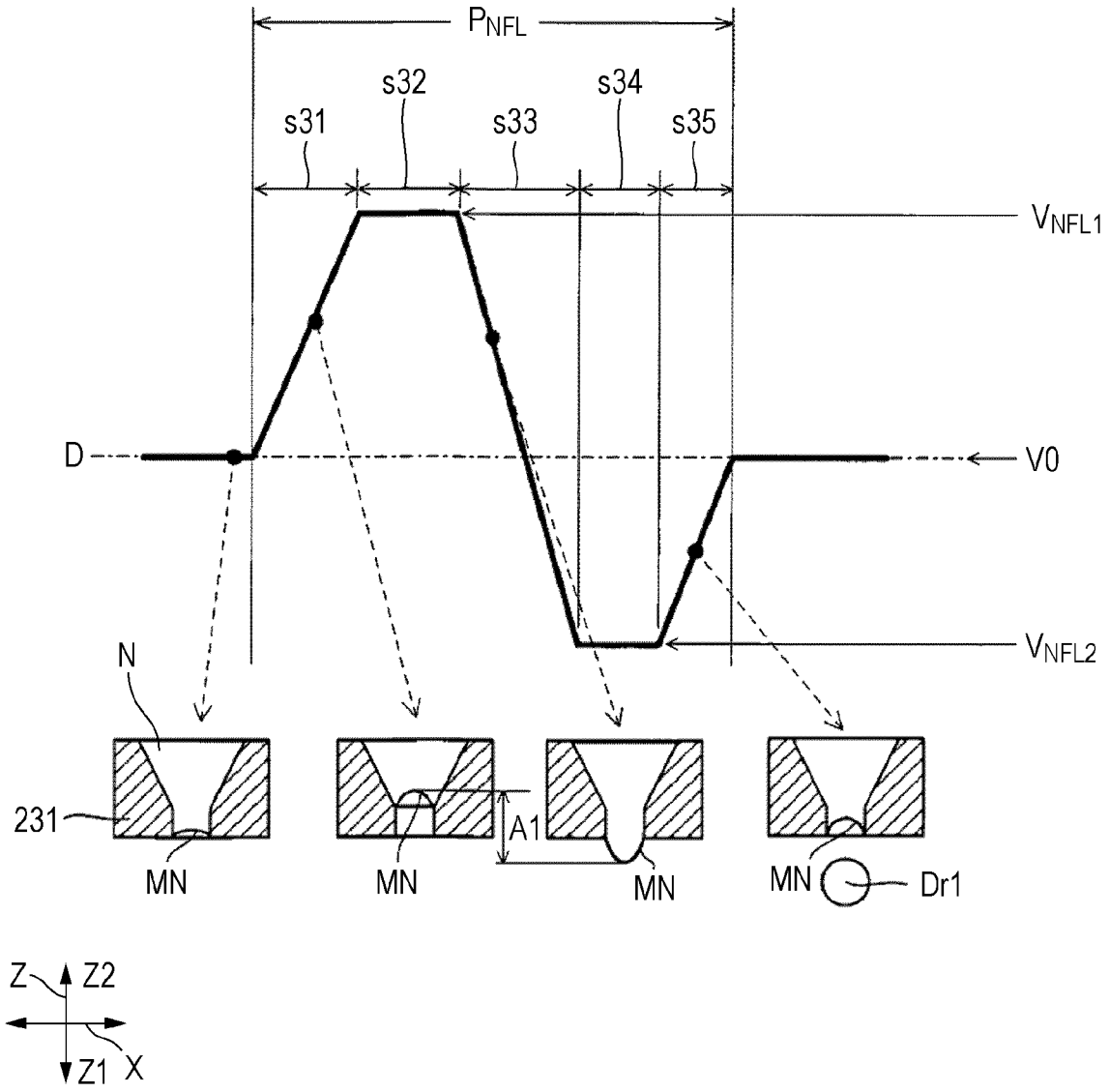
FIG. 6 is a diagram illustrating a normal flushing pulse and states of a meniscus.
Figure 7:
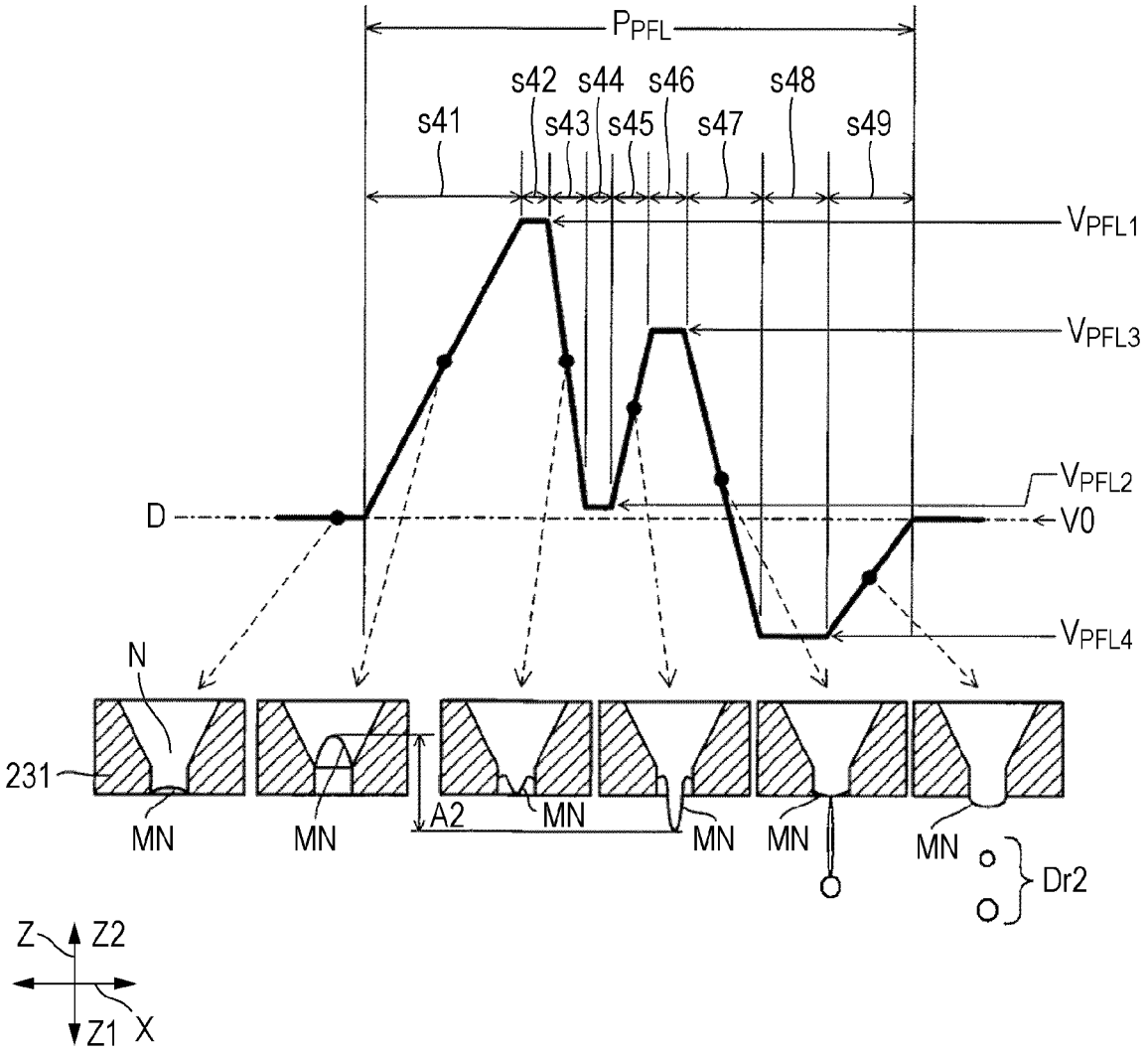
FIG. 7 is a diagram illustrating a power flushing pulse and states of a meniscus.

Similarly, the driving signal generation section 31 generates a driving signal D including a normal flushing pulse $P_{NFL}$ illustrated in FIG. 6 to execute the normal flushing operation and generates a power flushing pulse $P_{PFL}$ illustrated in FIG. 7 as the driving signal D to execute the power flushing operation. Note that the normal flushing pulse $P_{NFL}$ is an example of a "first flushing signal" and the power flushing pulse $P_{PFL}$ is an example of a "second flushing signal".

FIG. 4 is a diagram illustrating the first micro vibration pulse $P_{SV1}$ and states of the meniscus MN. The first micro vibration pulse $P_{SV1}$ includes intervals s11 to s13. In the interval s11, a potential rises from a predetermined reference potential V0. The rise in potential corresponds to reduction in volume of the pressure chamber C. In the interval s12, a potential $V_{bL}$ at an end of the interval s11 is maintained. In the interval s13, the potential $V_{bL}$ is reduced to the reference potential V0. The reduction in potential corresponds to increase in volume of the pressure chamber C.

In FIG. 4, a state of the meniscus MN before the interval s11, a state of the meniscus MN in the interval s11, and a state of the meniscus MN in the interval s13 are illustrated. Before the interval s11, the meniscus MN is positioned in the vicinity of the ejection surface of the nozzle N. In the interval s11, the meniscus MN moves in the Z2 direction. In the interval s13, the menisci MN moves in the Z1 direction.

FIG. 5 is a diagram illustrating a state of the second micro vibration pulse $P_{SV2}$ and states of the meniscus MN. The second micro vibration pulse $P_{SV2}$ includes intervals s21 to s23. In the interval s21, a potential rises from the predetermined reference potential V0. In the interval s22, a potential $V_{bH}$ at an end of the interval s21 is maintained. The potential $V_{bH}$ is higher than the potential $V_{bL}$. In the interval s23, the potential $V_{bH}$ is reduced to the reference potential V0.

In FIG. 5, a state of the meniscus MN before the interval s21, a state of the meniscus MN in the interval s21, and a state of the meniscus MN in the interval s23 are illustrated. Before the interval s21, the meniscus MN is positioned in the vicinity of the ejection surface of the nozzle N. In the interval s21, the meniscus MN moves in the Z2 direction. An amount of the movement of the meniscus MN in the interval s21 is larger than an amount of the movement of the meniscus MN in the interval s11. In the interval s23, the meniscus MN moves in the Z1 direction.

Potential amplitude of the second micro vibration pulse $P_{SV2}$ is in a range from the reference potential V0 to the potential $V_{bH}$ and potential amplitude of the first vibration pulse $P_{SV1}$ is in a range from the reference potential V0 to the potential $V_{bL}$. Since the potential $V_{bH}$ is higher than the potential $V_{bL}$, the potential amplitude of the second micro vibration pulse $P_{SV2}$ is larger than the potential amplitude of the first micro vibration pulse $P_{SV1}$. Accordingly, the pressure change applied to the ink by the second micro vibration pulse $P_{SV2}$ is larger than the pressure change applied to the ink by the first micro vibration pulse $P_{SV1}$.

FIG. 6 is a diagram illustrating the normal flushing pulse $P_{NFL}$ and states of the meniscus MN. The normal flushing pulse $P_{NFL}$ includes intervals s31 to s35. In the interval s31, a potential rises from the predetermined reference potential V0. In the interval s32, a potential $V_{NFL1}$ at an end of the interval s31 is maintained. In the interval s33, the potential $V_{NFL1}$ is reduced to a potential $V_{NFL2}$. In the interval s34, the potential $V_{NFL2}$ is maintained. In the interval s35, the potential $V_{NFL2}$ rises to the reference potential V0.

In FIG. 6, a state of the meniscus MN before the interval s31, a state of the meniscus MN in the interval s31, a state of the meniscus MN in the interval s33, and a state of the meniscus MN in the interval s35 are illustrated. The meniscus MN before the interval s31 is positioned in the vicinity of the ejection surface of the nozzle N. In the interval s31, the pressure chamber C swells and the meniscus MN moves in the Z2 direction. An amount of the movement of the meniscus MN in the interval s31 is larger than the amount of the movement of the meniscus MN in the interval s21. In the interval s33, the pressure chamber C shrinks and the meniscus MN moves in the Z1 direction. In the interval s34, the pressure chamber C swells and the meniscus MN moves in the Z2 direction and a droplet Dr1 is ejected from the nozzle N.

FIG. 7 is a diagram illustrating a power flushing pulse $P_{PFL}$ and states of the meniscus MN. The power flushing pulse $P_{PFL}$ includes intervals s41 to s49. In the interval s41, a potential rises from the predetermined reference potential V0. In the interval s42, a potential $V_{PFL1}$ at an end of the interval s41 is maintained. The potential $V_{PFL1}$ is higher than the potential $V_{NFL1}$. In the interval s43, the potential $V_{PFL1}$ is reduced. In the interval s44, a potential $V_{PFL2}$ at an end of the interval s43 is maintained. In the interval s45, the potential rises from the potential $V_{PFL2}$. In the interval s46, a potential $V_{PFL3}$ at an end of the interval s45 is maintained. In the interval s47, the potential $V_{PFL3}$ is reduced. In the interval s48, a potential $V_{PFL4}$ at an end of the interval s47 is maintained. In the interval s49, the potential $V_{PFL4}$ rises to the reference potential V0.

In FIG. 7, a state of the meniscus MN before the interval s41, a state of the meniscus MN in the interval s41, a state of the meniscus MN in the interval s43, a state of the meniscus MN in the interval s45, a state of the meniscus MN in the interval s47, and a state of the meniscus MN in the interval s49 are illustrated. Before the interval s41, the meniscus MN is positioned in the vicinity of the ejection surface of the nozzle N. In the interval s41, the pressure chamber C swells and the meniscus MN moves in the Z2 direction. An amount of the movement of the meniscus MN in the interval s41 is larger than the amount of the movement of the meniscus MN in the interval s31. In the interval s43, the pressure chamber C shrinks and the meniscus MN moves in the Z1 direction. In the interval s45, the pressure chamber C swells and a peripheral portion of the meniscus MN moves in the Z2 direction, and on the other hand, a center portion of the meniscus MN moves in the Z1 direction by the inertial force. In the interval s47, the pressure chamber C shrinks, a peripheral portion of the meniscus MN moves in the Z1 direction, a liquid surface of a center portion of the meniscus MN continuously extends in the Z1 direction by inertial force so as to form a liquid column. In the interval s49, when the pressure chamber C swells, the meniscus MN separated from the liquid column moves in the Z2 direction and the separated liquid column is ejected as a droplet Dr2 from the nozzle N.

In the normal flushing pulse $P_{NFL}$, the potential rises once and drops once. On the other hand, in the power flushing pulse $P_{PFL}$, the potential rises twice and drops twice at timings different from the normal flushing pulse $P_{NFL}$ for a pressure change in the pressure chamber C and the nozzle N so that a large change in the meniscus MN is attained. Therefore, a change in potential in the power flushing pulse $P_{PFL}$ is larger than a change in potential in the normal flushing pulse $P_{NFL}$. Accordingly, a pressure change applied to the ink by the power flushing pulse $P_{PFL}$ is larger than a pressure change applied to the ink by the normal flushing pulse $P_{NFL}$.

In a waveform of the normal flushing pulse $P_{NFL}$, the entire meniscus MN moves in the Z1 direction so as to have a convex shape projecting in the Z1 direction in the interval s33, the meniscus MN becomes a liquid column after moving in the Z1 direction from the ejection surface, and thereafter, the meniscus MN of the liquid surface separated from the liquid column moves in the Z2 direction in the interval s35.

On the other hand, in a waveform of the power flushing pulse $P_{PFL}$, after the meniscus MN is considerably drawn into the pressure chamber C in the interval s41, the pressure chamber C dramatically shrinks in the interval s43 so that a center portion of the meniscus MN which easily follows a pressure change moves in the Z1 direction more largely relative to a peripheral portion of the center portion. When the peripheral portion of the meniscus MN moves close to the ejection surface, the pressure chamber C dramatically swells in the interval s45 and the peripheral portion of the meniscus MN moves in the Z2 direction, and on the other hand, a liquid surface of the center portion of the meniscus MN extends in the Z1 direction by the inertial force so that a liquid column is formed. Thereafter, after the meniscus MN moves in the Z1 direction in the interval s47, the meniscus MN of the liquid surface separated from the liquid column in the interval s49 moves in the Z2 direction.

Specifically, an amount of the droplet Dr1 of the liquid column formed by the liquid surface of the entire meniscus MN of the normal flushing pulse $P_{NFL}$ is larger than an amount of the droplet Dr2 of the liquid column formed by the liquid surface only in the center portion of the meniscus MN of the power flushing pulse $P_{PFL}$. The amount of the droplet Dr1 and the amount of the droplet Dr2 indicate mass of the ejected ink. Furthermore, a period of the normal flushing pulse $P_{NFL}$ is shorter than a period of the power flushing pulse $P_{PFL}$. Accordingly, in the normal flushing pulse $P_{NFL}$, a larger amount of thickened ink may be discharged in a shorter period when compared with the power flushing pulse $P_{PFL}$.

On the other hand, an amplitude A2 of the meniscus MN of the power flushing pulse $P_{PFL}$ is larger than an amplitude A1 of the meniscus MN of the normal flushing pulse $P_{NFL}$, and the pressure chamber C drastically swells and shrinks by the power flushing pulse $P_{PFL}$. Accordingly, by the power flushing pulse $P_{PFL}$, the pressure in the pressure chamber C is increased when compared with the normal flushing pulse $P_{NFL}$ and ink is locally ejected in the vicinity of the center portion of the meniscus MN, so that ink having a certain degree of viscosity may be discharged.

Note that the waveforms of the first micro vibration pulse $P_{SV1}$, the second micro vibration pulse $P_{SV2}$, the normal flushing pulse $P_{NFL}$, and the power flushing pulse $P_{PFL}$ are appropriately changed. A pulse of a rectangle shape may be employed, for example, instead of a pulse of a trapezoidal shape. Furthermore, waveforms obtained by inverting rise and drop of potentials with respect to the reference potential V0 of the waveforms of the first micro vibration pulse $P_{SV1}$, the second micro vibration pulse $P_{SV2}$, the normal flushing pulse $P_{NFL}$, and the power flushing pulse $P_{PFL}$ may be employed depending on a configuration and characteristics of the driving element E.

A preparation operation will now be described with reference to the accompanying drawings. The preparation operation is performed to prepare an operation of printing an image on the medium 12 in accordance with the print job J (hereinafter referred to as a "printing operation"). Immediately after the liquid ejecting apparatus 100 is powered or immediately before the printing operation is started when a long period of time has elapsed after a preceding printing operation, for example, the preparation operation is executed as illustrated below.

FIG. 8 is a diagram illustrating a list of operations performed by the liquid ejecting apparatus 100 in accordance with a thickening state in the preparation operation. Although a degree of increase in viscosity of the ink in the vicinity of the meniscus MN included in the nozzle N may be reduced by the micro vibration operation, the thickened ink is stirred and dispersed, and therefore, the number of times the flushing operation is performed to sufficiently discharge the thickened ink is required to be increased when the micro vibration operation is executed. When the number of times the flushing operation is performed is increased, a consumption amount of the ink which does not directly contribute to formation of an image is increased, and therefore, it is not preferable to unnecessarily execute the flushing operation.

In the state Qa, the state Qb, and the state Qc, a degree of increase in viscosity of the ink is low, and therefore, the ink may be ejected by the power flushing pulse $P_{PFL}$ without the micro vibration operation. Accordingly, as illustrated in FIG. 8, the liquid ejecting apparatus 100 does not execute the micro vibration operation before the flushing operation. On the other hand, in the state Qd and the state Qe, the viscosity is increased to such an extent that the ink is not ejected without the micro vibration operation, and therefore, the liquid ejecting apparatus 100 executes both the micro vibration operation and the flushing operation as illustrated in FIG. 8. In the state Qe, a degree of increase in viscosity is higher than the state Qd, and therefore, a larger pressure change is required to be applied to the ink to reduce the increase in viscosity by the micro vibration operation until ejection of the ink becomes available. Accordingly, in the state Qe, the driving circuit 25 supplies the second micro vibration pulse $P_{SV2}$ having a pressure change to be applied to the ink larger than that of the first micro vibration pulse $P_{SV1}$. On the other hand, in the state Qd, the degree of increase in viscosity is lower than the state Qe, and therefore, the driving circuit 25 supplies the first micro vibration pulse $P_{SV1}$ having a pressure change to be applied to the ink which is smaller than the second micro vibration pulse $P_{SV2}$. When the first micro vibration pulse $P_{SV1}$ is supplied, the degree of increase in viscosity of the ink in the vicinity of the meniscus MN may be reduced to such an extent that ejection of the ink becomes available, and dispersion due to stirring of the thickened ink may be suppressed when compared with the case where the second micro vibration pulse $P_{SV2}$ is supplied.

In the power flushing operation, the driving circuit 25 supplies the power flushing pulse $P_{PFL}$ M1 times in each of the states Qa to Qe. The number M1 is an example of a "first number". The number M1 indicates the number of times discharge of the thickened ink in the vicinity of the meniscus MN in the nozzle N is available and is set based on experience or experiment of a developer of the liquid ejecting apparatus 100.

In the normal flushing operation, the thickened ink existing only in the vicinity of the meniscus MN may be sufficiently ejected by the power flushing operation, and therefore, the driving circuit 25 does not supply the normal flushing pulse $P_{NFL}$ in the state Qa. In other words, in the state Qa, the thickened ink may be sufficiently ejected only by the power flushing operation.

In the states Qb to Qe, although the highly thickened ink is discharged in the vicinity of the meniscus MN by the power flushing operation performed M1 times, the thickened ink which degrades print quality is still included in the nozzle N. To efficiently eject the thickened ink, the driving circuit 25 supplies the normal flushing pulse $P_{NFL}$ which attains a larger ejection amount per ejection than the power flushing pulse $P_{PFL}$. The driving circuit 25 supplies the normal flushing pulse $P_{NFL}$ M4 times in the state Qb, supplies the normal flushing pulse $P_{NFL}$ M5 times in the state Qc, supplies the normal flushing pulse $P_{NFL}$ M2 times in the state Qd, and supplies the normal flushing pulse $P_{NFL}$ M3 times in the state Qe.

The numbers M2 to M5 satisfy Expression (1) below.

$$M4<M5<M2<M3 \quad (1)$$

(1) According to Expression (1) and FIG. 8, the number of times the normal flushing pulse $P_{NFL}$ is supplied monotonically increases in accordance with increase in viscosity so that the thickened ink is sufficiently ejected. Specifically, the number M3 is larger than the number M2. The number M4 is smaller than the number M2. The number M5 is larger than the number M4 and smaller than the number M2.

The number M4 indicates the number of times the thickened ink is ejected so that the thickened ink is sufficiently ejected in the state Qb. The number M5 indicates the number of times the thickened ink is ejected so that the thickened ink is sufficiently ejected in the state Qc. The number M2 indicates the number of times the thickened ink is ejected so that the thickened ink is sufficiently ejected in the state Qd. The number M3 indicates the number of times the thickened ink is ejected so that the thickened ink is sufficiently ejected in the state Qe. The numbers M4, M5, M2, and M3 are set based on experience or experiment of the developer of the liquid ejecting apparatus 100. Note that the number M4 is an example of a "fourth number". The number M5 is an example of a "fifth number". The number M2 is an example of a "second number". The number M3 is an example of a "third number".

Figure 9:
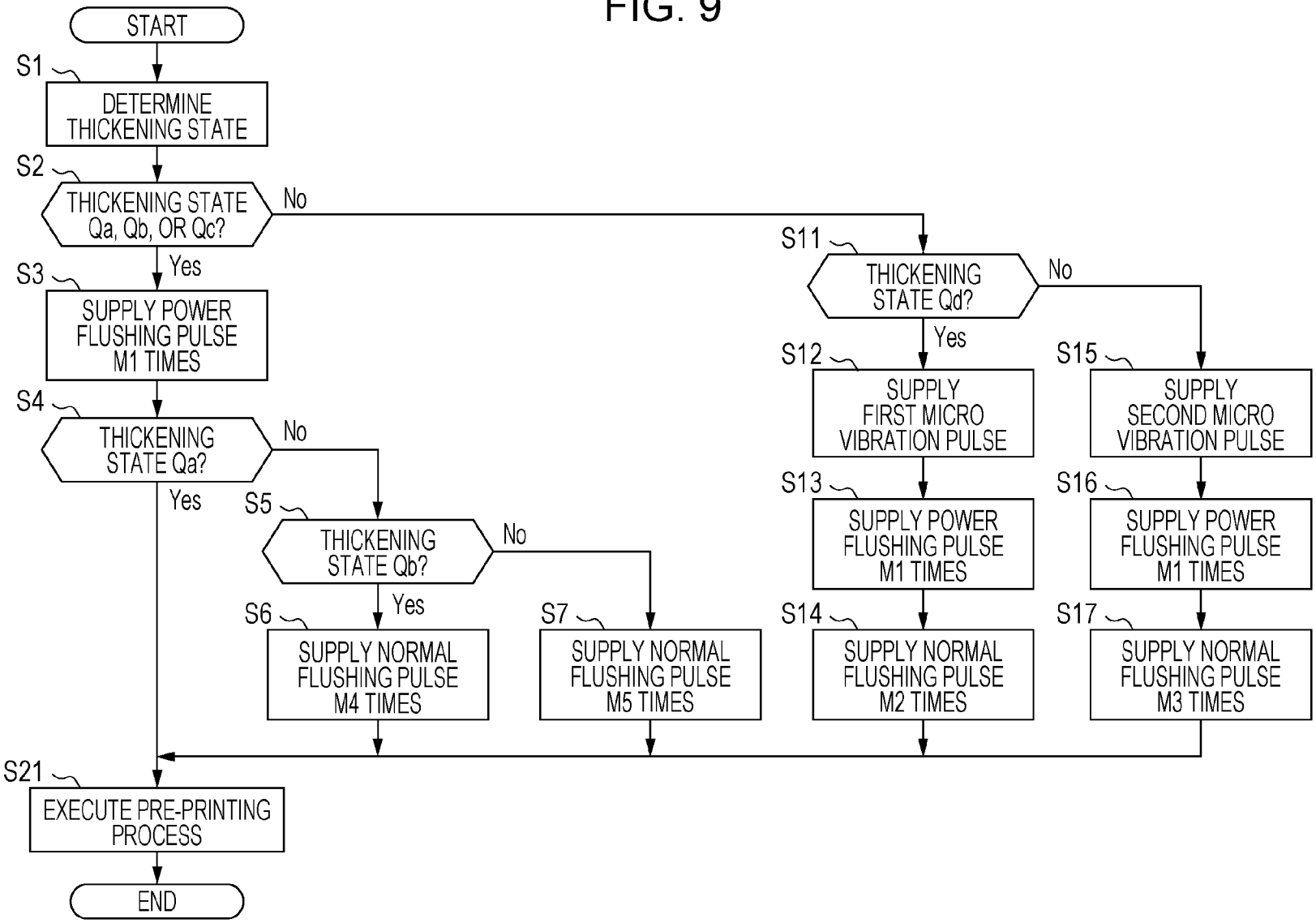
FIG. 9 is a flowchart of a procedure of a preparation operation.

FIG. 9 is a flowchart of a concrete procedure of the preparation operation. When the control unit 21 receives the print job J, the thickening determination section 32 determines a thickening state in step S1 and determines whether a thickening state is one of states Qa to Qc in step S2. When the thickening state is one of the states Qa to Qc (S2: Yes), the driving circuit 25 supplies the power flushing pulse $P_{PFL}$ M1 times to the individual driving elements E in step S3.

After the process in step S3, the thickening determination section 32 determines whether the thickening state is the state Qa in step S4. When the thickening state is the state Qa (S4: Yes), the driving circuit 25 executes a pre-printing process in step S21, and thereafter, terminates the preparation operation. The pre-printing process will be described hereinafter. When the preparation operation is terminated in accordance with the procedure described above, the control unit 21 causes the liquid ejecting head 23 to perform a printing operation in accordance with the print job J. As illustrated above, when the thickening state is the state Qa, the driving circuit 25 does not supply the micro vibration pulse $P_{SV}$ before the flushing operation, supplies the power flushing pulse $P_{PFL}$ M1 times, and does not supply the normal flushing pulse $P_{NFL}$ to the individual driving elements E.

When the thickening state is the state Qb or the state Qc (S4: No), the thickening determination section 32 determines whether the thickening state is the state Qb in step S5. When the thickening state is the state Qb (S5: Yes), the driving circuit 25 supplies the normal flushing pulse $P_{NFL}$ M4 times to the driving elements E in step S6. After the process in step S6, the driving circuit 25 executes the process in step S21, and thereafter, terminates the preparation process. As illustrated above, when the thickening state is the state Qb, the driving circuit 25 does not supply the micro vibration pulse $P_{SV}$ before the flushing operation, supplies the power flushing pulse $P_{PFL}$ M1 times, and supplies the normal flushing pulse $P_{NFL}$ M4 times to the individual driving elements E.

Figure 10:
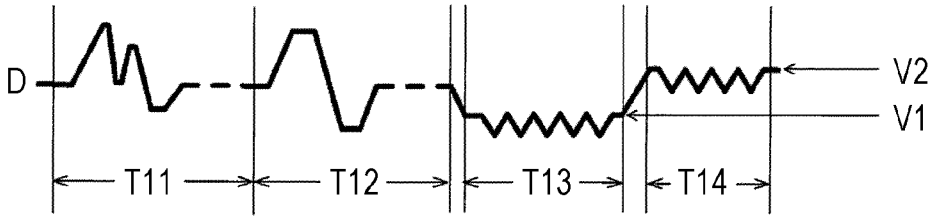
FIG. 10 is a diagram illustrating a driving signal obtained in a thickening state Qb.

FIG. 10 is a diagram illustrating a driving signal D successively supplied to the driving elements E when the thickening state is the state Qb. The driving circuit 25 supplies appropriate driving pulses of the driving signal D to the individual driving elements E in intervals T11 to T14 illustrated in FIG. 10. In the interval T11, the driving circuit 25 supplies M1 power flushing pulses $P_{PFL}$ to the individual driving elements E in accordance with the process in step S3. In the interval T12, the driving circuit 25 supplies M4 normal flushing pulses $P_{NFL}$ to the individual driving elements E in accordance with the process in step S6.

In the intervals T13 and T14, the pre-printing process described above is executed. In the pre-printing process, the micro vibration pulse $P_{SV}$ is supplied to the individual driving elements E. The micro vibration pulse $P_{SV}$ used in the pre-printing process is the first micro vibration pulse $P_{SV1}$ illustrated in FIG. 4 or the second micro vibration pulse $P_{SV2}$ illustrated in FIG. 5. Specifically, in the interval T13, the micro vibration pulse $P_{SV}$ having a potential V1 as the reference potential V0 is supplied a plurality of times to the individual driving elements E. On the other hand, in the interval T14, the micro vibration pulse $P_{SV}$ having a potential V2 as the reference potential V0 is supplied a plurality of times to the individual driving elements E. The potential V1 is lower than the potential V2. This is because the potential V2 is set to be close to a potential of the driving signal D at a time of start of the printing operation. Furthermore, since the potential V1 is lower than the potential V2, pressure oscillation by the micro vibration pulse $P_{SV}$ is increased.

Description will now be made with reference to FIG. 9 again. When the thickening state is the state Qc (S5: No), the driving circuit 25 supplies the normal flushing pulse $P_{NFL}$ M5 times to the individual driving elements E in step S7. After the process in step S7, the driving circuit 25 executes the pre-printing process in step S21, and thereafter, terminates the preparation process illustrated in FIG. 9. As illustrated above, when the thickening state is the state Qc, the driving circuit 25 does not supply the micro vibration pulse $P_{SV}$ before the flushing operation, supplies the power flushing pulse $P_{PFL}$ M1 times, and supplies the normal flushing pulse $P_{NFL}$ M5 times to the individual driving elements E.

When the thickening state is the state Qd or the state Qe (S2: No), the thickening determination section 32 determines whether the thickening state is the state Qd in step S11. When the thickening state is the state Qd (S11: Yes), the driving circuit 25 supplies the first micro vibration pulse $P_{SV1}$ to the individual driving elements E in step S12. The first micro vibration pulse $P_{SV1}$ is supplied a plurality of times to the individual driving elements E. Subsequently, the driving circuit 25 supplies the power flushing pulse $P_{PFL}$ M1 times to the individual driving elements E in step S13. Then the driving circuit 25 supplies the normal flushing pulse $P_{NFL}$ M2 times to the individual driving elements E in step S14. After the process in step S14, the driving circuit 25 executes the pre-printing process in step S21, and thereafter, terminates the preparation process illustrated in FIG. 9. As illustrated above, when the thickening state is the state Qd, the driving circuit 25 supplies the first micro vibration pulse $P_{SV1}$, supplies the power flushing pulse $P_{PFL}$ M1 times, and supplies the normal flushing pulse $P_{NFL}$ M2 times to the individual driving elements E.

Figure 11:
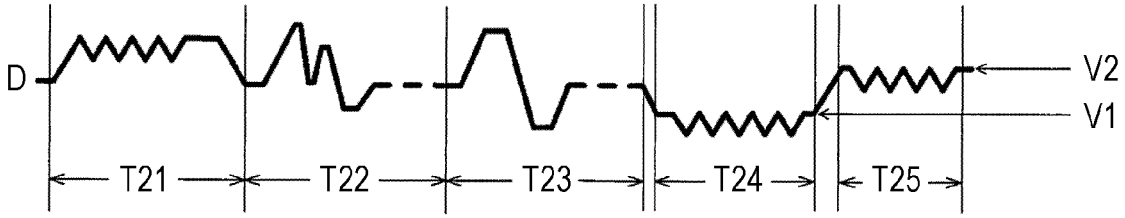
FIG. 11 is a diagram illustrating a driving signal obtained in a thickening state Qd.

FIG. 11 is a diagram illustrating the driving signal D successively supplied to the driving elements E when the thickening state is the state Qd. The driving circuit 25 supplies appropriate driving pulses of the driving signal D to the individual driving elements E in intervals T21 to T25 illustrated in FIG. 11. In the interval T21, the driving circuit 25 supplies the first micro vibration pulses $P_{SV1}$ to the individual driving elements E in accordance with the process in step S12. In the interval T22, the driving circuit 25 supplies M1 power flushing pulses $P_{PFL}$ to the individual driving elements E in accordance with the process in step S13. In the interval T23, the driving circuit 25 supplies M2 normal flushing pulses $P_{NFL}$ to the individual driving elements E in accordance with the process in step S14. In the intervals T24 and T25, the pre-printing process is executed. Specifically, the driving circuit 25 supplies the micro vibration pulses $P_{SV}$ having a potential V1 as the reference potential V0 in the interval T24 and supplies the micro vibration pulses $P_{SV}$ having a potential V2 as the reference potential V0 in the interval T25.

Description will now be made with reference to FIG. 9 again. When the thickening state is the state Qe (S11: No), the driving circuit 25 supplies the second micro vibration pulse $P_{SV2}$ to the individual driving elements E in step S15. The second micro vibration pulse $P_{SV2}$ is supplied a plurality of times to the individual driving elements E. Subsequently, the driving circuit 25 supplies the power flushing pulse $P_{PFL}$ M1 times to the individual driving elements E in step S16. Then the driving circuit 25 supplies the normal flushing pulse $P_{NFL}$ M3 times to the individual driving elements E in step S17. After the process in step S17, the driving circuit 25 executes the pre-printing process in step S21, and thereafter, terminates the preparation process illustrated in FIG. 9. As illustrated above, when the thickening state is the state Qe, the driving circuit 25 supplies the second micro vibration pulse $P_{SV2}$, supplies the power flushing pulse $P_{PFL}$ M1 times, and supplies the normal flushing pulse $P_{NFL}$ M3 times to the individual driving elements E.

As illustrated above, according to this embodiment, when the thickening determination section 32 determines that the thickening state of the ink included in the nozzle N is the state Qa, the micro vibration pulse $P_{SV}$ is not supplied to the driving elements E but supplies the power flushing pulse $P_{PFL}$ M1 times. On the other hand, when the thickening determination section 32 determines that the thickening state of the ink included in the nozzle N is the state Qd, the first micro vibration pulse $P_{SV1}$ is supplied to the driving elements E, the power flushing pulse $P_{PFL}$ is supplied M1 times to the driving elements E after the first micro vibration pulse $P_{SV1}$ is supplied, and the normal flushing pulse $P_{NFL}$ is supplied M2 times to the driving elements E after the power flushing pulse $P_{PFL}$ is supplied.

Although a degree of increase in viscosity of the ink in the vicinity of the meniscus MN included in the nozzle N may be reduced by the micro vibration operation, the thickened ink is stirred and dispersed. In the state Qa in which the viscosity of the ink is not so increased, the thickened ink is ejected by the power flushing pulse $P_{PFL}$ without reducing increase in viscosity by supplying the micro vibration pulse $P_{SV}$. In addition, since the micro vibration pulse $P_{SV}$ is not supplied, the thickened ink is not dispersed due to stirring, and therefore, an amount of ink to be discharged may be suppressed to be small.

On the other hand, in the state Qd in which the viscosity of the ink is increased when compared with the state Qa, when the first micro vibration pulse $P_{SV1}$ is supplied, the thickened ink having viscosity locally increased in the vicinity of the meniscus MN and ink which is not thickened near the pressure chamber C are stirred so that the thickening state in the vicinity of the meniscus MN may be improved to such an extent that the ink may be ejected by the power flushing pulse $P_{PFL}$. Since the stirring is performed by supplying the first micro vibration pulse $P_{SV1}$, the thickened ink is dispersed from the portion in the vicinity of the meniscus MN to the pressure chamber C. First, when the power flushing pulse $P_{PFL}$ which causes a larger pressure change than the normal flushing pulse $P_{NFL}$ is supplied, ink of higher viscosity may be ejected from the nozzle N in the vicinity of the meniscus MN. After the ink of the higher viscosity is discharged by supplying the power flushing pulse $P_{PFL}$ and the viscosity of the ink included in the nozzle N is reduced, the normal flushing pulse $P_{NFL}$ which causes ejection of a larger amount of ink per ejection than the power flushing pulse $P_{PFL}$ is supplied to efficiently eject the dispersed thickened ink, so that the thickened ink may be ejected the smaller number of times and a shorter period of time than an example in which the power flushing pulse $P_{PFL}$ is supplied. As described above, according to this embodiment, the thickened ink may be efficiently ejected in accordance with the thickening state of the ink included in the nozzle N.

When the thickening determination section 32 determines that the thickening state of the ink included in the nozzle N is the state Qe, the second micro vibration pulse $P_{SV2}$ is supplied to the driving elements E, the power flushing pulse $P_{PFL}$ is supplied M1 times to the driving elements E after the second micro vibration pulse $P_{SV2}$ is supplied, and the normal flushing pulse $P_{NFL}$ is supplied M3 times to the driving elements E after the power flushing pulse $P_{PFL}$ is supplied. In the state Qe in which the viscosity of ink is increased when compared with the state Qd, the thickened ink may be appropriately ejected by supplying the normal flushing pulse $P_{NFL}$ M3 times which is larger than M2 times.

According to this embodiment, a pressure change by the second micro vibration pulse $P_{SV2}$ obtained when the thickening determination section 32 determines that the thickening state of the ink included in the nozzle N is the state Qe is larger than a pressure change by the first micro vibration pulse $P_{SV1}$ obtained when the thickening determination section 32 determines that the thickening state of the ink included in the nozzle N is the state Qd. In the state Qe in which the viscosity of the ink is larger than the state Qd, the local thickening state in the vicinity of the meniscus MN may be reduced to such an extent that the ink is discharged by the power flushing pulse $P_{PFL}$ by increasing the pressure change of the micro vibration operation when compared with the state Qd.

When the thickening determination section 32 determines that the thickening state of the ink included in the nozzle N is the state Qb, the micro vibration pulse $P_{SV}$ is not supplied to the driving elements E before the flushing operation, the power flushing pulse $P_{PFL}$ is supplied M1 times, and the normal flushing pulse $P_{NFL}$ is supplied M4 times to the driving elements E after the power flushing pulse $P_{PFL}$ is supplied.

In the state Qb between the state Qa and the state Qd, the thickened ink is larger than that in the state Qa and smaller than that in the state Qd. Accordingly, since the number of times the normal flushing pulse $P_{NFL}$ is supplied is M4 which is smaller than M2 in the state Qd, the thickened ink may be appropriately ejected.

When the thickening determination section 32 determines that the thickening state of the ink included in the nozzle N is the state Qc, the micro vibration pulse $P_{SV}$ is not supplied to the driving elements E, the power flushing pulse $P_{PFL}$ is supplied M1 times, and the normal flushing pulse $P_{NFL}$ is supplied to the driving element E M5 times which is larger than M4 times and smaller than M2 times after the power flushing pulse $P_{PFL}$ is supplied. In the state Qc between the state Qb and the state Qd, the thickened ink is larger than that in the state Qb and smaller than that in the state Qd. Accordingly, when the number of times the normal flushing pulse $P_{NFL}$ is supplied is M5 times which is larger than M4 times in the state Qb and smaller than M2 times in the state Qd, the thickened ink may be appropriately ejected.

An amplitude A2 of the meniscus MN of the nozzle N when the power flushing pulse $P_{PFL}$ is supplied to the driving element E is larger than an amplitude A1 of the meniscus of the nozzle N when the normal flushing pulse $P_{NFL}$ is supplied to the driving element E. Since the amplitude A2 by the power flushing pulse $P_{PFL}$ is larger than the amplitude A1 by the normal flushing pulse $P_{NFL}$, the ink may be ejected by the power flushing pulse $P_{PFL}$ even when the viscosity in the vicinity of the meniscus MN is increased and the thickening state in which the ink may not be ejected by the normal flushing pulse $P_{NFL}$ is entered.

B. MODIFICATION

The foregoing embodiment may be variously modified. Modifications will be illustrated in detail hereinafter. Two or more modifications arbitrarily selected from examples described below may be appropriately combined as long as the modifications do not contradict each other. Note that, in the modifications illustrated below, elements having operations and functions the same as those of the foregoing embodiment are denoted by reference numerals the same as those described above, and detailed descriptions thereof are appropriately omitted.

(1) Although the thickening determination section 32 determines the thickening state of the ink based on the elapsed time H in the foregoing embodiment, the method for determining the thickening state is not limited to that illustrated above. For example, the thickening determination section 32 may determine the thickening state using a mode 1 to a mode 5.

Mode 1A:

The thickening determination section 32 determines the thickening state of the ink based on residual vibration obtained when the pressure in the pressure chamber C is changed, for example. As a driving pulse for generating the residual vibration, a non-ejection pulse not to eject ink from the nozzle N may be supplied to the driving elements E or a pulse for inspection may be supplied to the driving elements E. The thickening determination section 32 detects an electromotive force generated in the driving element E when the residual vibration in the pressure chamber C propagates to the driving element E as a signal representing a waveform of the residual vibration. The storage device 212 stores a table including a residual vibration characteristic and a thickening state which are associated with each other. The thickening determination section 32 searches the table for a thickening state corresponding to the residual vibration characteristic of the nozzle N included in a certain one of the liquid ejecting sections 26. Examples of the residual vibration characteristic include amplitude, cycle, and an attenuation rate of the residual vibration. As described above, according to the configuration in which the residual vibration is referred to, it is advantageous in that the thickening state of the ink included in the nozzle N may be estimated with thigh accuracy.

Mode 1B:

In the mode 1B, the thickening determination section 32 determines the thickening state of the ink based on a type of ink included in the liquid container 14. Examples of the type include ink including pigment and ink including dye. Hereinafter, the ink including pigment is referred to as "pigment ink" and the ink including dye is referred to as "dye ink". Viscosity of the pigment ink is more easily increased when compared with the dye ink. Therefore, when a type of ink included in the liquid container 14 indicates the pigment ink, viscosity of the ink included in the liquid container 14 is increased when compared with an example in which a type of ink included in the liquid container 14 is the dye ink. When it is determined that the ink included in the liquid container 14 is the pigment ink, for example, the driving circuit 25 supplies the power flushing pulse $P_{PFL}$ to the driving elements E M1 times, and thereafter, the driving circuit 25 supplies the normal flushing pulse $P_{NFL}$ L1 times. On the other hand, when it is determined that the ink included in the liquid container 14 is the dye ink, for example, the driving circuit 25 supplies the power flushing pulse $P_{PFL}$ M1 times to the driving element E, and thereafter, the driving circuit 25 supplies the normal flushing pulse $P_{NFL}$ L2 times to the driving elements E. The number L1 is larger than the number L2.

Mode 1C:

In a mode 1C, the thickening determination section 32 determines a thickening state of the ink based on a type of ink and the elapsed time H. The storage device 212 stores a table in which a type of ink, the elapsed time H, and the thickening state are associated with each other. The thickening determination section 32 searches the table for a thickening state corresponding to the type of ink and the elapsed time H.

Mode 1D:

In a mode 1D, it is assumed that the liquid container 14 is a detachable cartridge. The thickening determination section 32 may determine a thickening state of the ink based on an elapsed time from a time point when the liquid container 14 is attached to a current time point. Similarly, when the liquid container 14 is an ink tank, the thickening determination section 32 may determine a thickening state of the ink based on an elapsed time from a time point when the liquid container 14 is charged with the ink to a current time point.

Mode 1E:

In a mode 1E, the thickening determination section 32 determines a thickening state based on a result of a detection of a state of the ink included in the nozzle N by an optical sensor.

Mode 1F:

In a mode 1F, the thickening determination section 32 determines a thickening state based on a result of printing of a predetermined test pattern on the medium 12. For example, it is determined that viscosity is increased as an error of a position where the ink is landed on the medium 12 is large.

(2) Although the micro vibration pulse $P_{SV}$ supplied when the thickening state is the state Qd is the first micro vibration pulse $P_{SV1}$, and the micro vibration pulse $P_{SV}$ supplied when the thickening state is the state Qe is the second micro vibration pulse $P_{SV2}$ in the foregoing embodiments, the present disclosure is not limited to these. For example, even when the thickening state is the state Qe, the driving circuit 25 may supply the first micro vibration pulse $P_{SV1}$. Note that the driving circuit 25 supplies the first micro vibration pulse $P_{SV1}$ when the thickening state is the state Qe a number of times larger than the number of times the first micro vibration pulse $P_{SV1}$ is supplied when the thickening state is the state Qd.

(3) Although one of the five thickening states is determined in the foregoing embodiments, it may be determined one of four or less thickening states or one of six or more thickening states. An example in which one of six or more thickening states is determined will be described with reference to FIG. 12.

Figure 12:
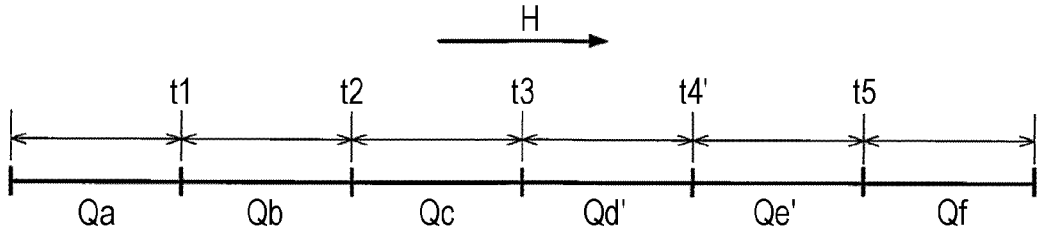
FIG. 12 is a diagram illustrating thickening states according to a modification.

FIG. 12 is a diagram illustrating a thickening state according to a modification. The thickening determination section 32 determines one of six thickening states, that is, states Qa, Qb, Qc, Qd', Qe', and Qf. The state Qd' indicates that a degree of increased viscosity is high. The state Qf indicates that a degree of increased viscosity is extremely high. The state Qe' indicates that a degree of increased viscosity is between the state Qd' and the state Qf.

Note that, in this modification, the state Qd' is an example of a "second state". The state Qf is an example of a "third state". The state Qe' is an example of a "state between the second state and the third state".

When an elapsed time H is equal to or larger than a threshold value t3 and smaller than a threshold value t4', the thickening determination section 32 determines that the thickening state is the state Qd' as illustrated in FIG. 12. The threshold value t4' is larger than the threshold value t3. When the elapsed time H is equal to or larger than the threshold value t4' and smaller than the threshold value t5, the thickening determination section 32 determines that the thickening state is the state Qe'. The threshold value t5 is larger than the threshold value t4'. When the elapsed time H is equal to or longer than the threshold value t5, the thickening determination section 32 determines that the thickening state is the state Qf.

FIG. 13 is a diagram illustrating a list of operations of the liquid ejecting apparatus 100 in accordance with a thickening state according to the modification. When the thickening determination section 32 determines that the thickening state is the state Qd', the driving circuit 25 supplies the first micro vibration pulse $P_{SV1}$ to the individual driving elements E as illustrated in FIG. 13, supplies the power flushing pulse $P_{PFL}$ M1 times, and supplies the normal flushing pulse $P_{NFL}$ M2' times. When the thickening determination section 32 determines that the thickening state is the state Qe', the driving circuit 25 supplies the second micro vibration pulse $P_{SV2}$ to the individual driving elements E as illustrated in FIG. 13, supplies the power flushing pulse $P_{PFL}$ M1 times, and supplies the normal flushing pulse $P_{NFL}$ M3' times. When the thickening determination section 32 determines that the thickening state is the state Qf, the driving circuit 25 supplies the second micro vibration pulse $P_{SV2}$ to the individual driving elements E as illustrated in FIG. 13, supplies the power flushing pulse $P_{PFL}$ M1 times, and supplies the normal flushing pulse $P_{NFL}$ M6 times.

The numbers M2', M3', M4, M5, and M6 satisfy Expression (2) below.

$$M4<M5<M2'<M3'<M6 \quad (2)$$

According to Expression (2), the number M3' is larger than the number M2' and smaller than the number M6. Note that, in this modification, the number M2' is an example of the "second number". The number M6 is an example of the "third number". The number M3' is an example of a "number larger than the second number and smaller than the third number".

In this modification, when the thickening determination section 32 determines that the thickening state is the state Qe', the driving circuit 25 supplies the second micro vibration pulse $P_{SV2}$ to the driving elements E. However, the present disclosure is not limited to this. For example, when the thickening determination section 32 determines that the thickening state is the state Qe', the driving circuit 25 may supply the micro vibration pulse $P_{SV}$ which causes a pressure change which is larger than the pressure change caused by the first micro vibration pulse $P_{SV1}$ and which is smaller than a pressure change caused by the second micro vibration pulse $P_{SV2}$ to the ink included in the pressure chamber C.

(4) Although the number of times the power flushing pulse $P_{PFL}$ is supplied is M1 irrespective of the thickening state in the foregoing embodiments, the number may be changed in accordance with the thickening state. Specifically, when a degree of viscosity exceeds a predetermined degree, the number of times the power flushing pulse $P_{PFL}$ is supplied may be increased. By this, even when viscosity of the ink in the vicinity of the meniscus MN is increased, the ink having the increased viscosity in the vicinity of the meniscus MN may be sufficiently discharged to such an extent that the ink may be ejected by the normal flushing pulse $P_{NFL}$. However, as described above, since a larger amount of thickened ink may be discharged by the normal flushing pulse $P_{NFL}$ within a short period of time, the number of times the power flushing pulse $P_{PFL}$ is supplied is preferably set to be minimum.

(5) Although thickening states of the ink in the plurality of nozzles N are the same according to the foregoing embodiments, the thickening determination section 32 may individually determine the thickening states of the nozzles N.

(6) Although solvent included in the ink is water in the foregoing embodiments, the solvent is not limited to water as long as the solvent has volatile property. For example, the solvent may be volatile organic solvent. Examples of the organic solvent include ketone, alcohol, and ethyl acetate.

(7) Although the driving element E is used for the ejection of ink and the micro vibration in common in the foregoing embodiments, different driving elements E may be used for the ejection of ink and the micro vibration. Configurations of the driving element E for the ejection and the driving element E for the micro vibration may be the same or different. For example, a heat element may be used as the driving element E for the ejection and a piezoelectric element may be used as the driving element E for the micro vibration.

(8) Although the liquid ejecting apparatus 100 of a serial type which causes the transport body 242 having the liquid ejecting head 23 mounted thereon to reciprocate is illustrated in the foregoing embodiments, the present disclosure is applicable to a liquid ejecting apparatus of a line type having a plurality of nozzles N distributed in an entire width of the medium 12.

(9) The liquid ejecting apparatus 100 illustrated in the foregoing embodiments may be employed in various apparatuses including facsimile apparatuses and photocopiers in addition to apparatuses dedicated for printing. Note that usage of the liquid ejecting apparatus is not limited to printing. For example, a liquid ejecting apparatus ejecting solution of color material is used as a manufacturing apparatus forming a color filter of a display apparatus, such as a liquid crystal display panel. Furthermore, the liquid ejecting apparatus ejecting solution of conductive material is used as a manufacturing apparatus forming wiring and electrodes of a wiring substrate. Furthermore, a liquid ejecting apparatus ejecting organic solution associated with living bodies is used as a manufacturing apparatus manufacturing biochips, for example.

C: APPENDIX

The following configurations, for example, are obtained according to the embodiments illustrated above.

A method for driving a liquid ejecting apparatus according to a first preferred mode is provided. The liquid ejecting apparatus includes a liquid ejecting section including a nozzle ejecting liquid, a pressure chamber communicated with the nozzle, and a driving element applying a pressure change to the liquid included in the pressure chamber, a driving signal generation section configured to generate a micro vibration signal which is supplied to the driving element and which applies a pressure change to such an extent that the liquid is not ejected from the nozzle, a first flushing signal which is supplied to the driving element and which applies a pressure change to the liquid included in the pressure chamber to such an extent that the liquid is ejected from the nozzle, and a second flushing signal which is supplied to the driving element and which applies a pressure change to the liquid included in the pressure chamber to such an extent that the liquid is ejected from the nozzle, and a thickening determination section configured to determine a thickening state of the liquid included in the nozzle. The pressure change by the second flushing signal is larger than the pressure change by the first flushing signal. An amount of liquid ejected from the nozzle when the first flushing signal is supplied to the driving element once is larger than an amount of liquid ejected from the nozzle when the second flushing signal is supplied to the driving element once. When the thickening determination section determines that a thickening state of the liquid included in the nozzle is a first state, the micro vibration signal is not supplied to the driving element and the second flushing signal is supplied to the driving element a first number of times. When the thickening determination section determines that the thickening state of the liquid included in the nozzle is a second state in which viscosity of the liquid is higher than viscosity of the liquid in the first state, the micro vibration signal is supplied to the driving element, the second flushing signal is supplied to the driving element the first number of times after the micro vibration signal is supplied, and the first flushing signal is supplied to the driving element a second number of times after the second flushing signal is supplied.

Liquid having increased viscosity is stirred by supplying a micro vibration signal. In a first state in which viscosity of the liquid is not so increased, the liquid having increased viscosity is ejected by the second flushing signal without reducing viscosity by supplying the micro vibration pulse. In addition, the liquid having increased viscosity is not stirred since the micro vibration signal is not supplied.

On the other hand, in a second state in which the viscosity is increased from the first state, a local thickening state is improved when the micro vibration signal is supplied, and the liquid may be ejected even in a state in which the viscosity is increased from a state in which the first flushing signal is supplied since the second flushing signal causing a pressure change larger than a pressure change of the first flushing signal is supplied. Note that the liquid having increased viscosity is stirred by supplying the micro vibration signal. After the increased viscosity is reduced by supply of the second flushing signal, the first flushing signal which enables ejection of a larger amount of liquid per ejection than the second flushing signal is supplied to efficiently eject stirred ink so that liquid having increased viscosity may be ejected when the ejection is performed a number of times smaller than a number of times ejection is performed when the second flushing signal is supplied.

In a second mode which is a concrete example of the first mode, when the thickening determination section determines that the thickening state of the liquid included in the nozzle is a third state in which viscosity of the liquid is higher than the viscosity in the second state, the micro vibration signal is supplied to the driving element, the second flushing signal is supplied to the driving element the first number of times after the micro vibration signal is supplied, and the first flushing signal is supplied to the driving element a third number of times which is larger than the second number of times after the second flushing signal is supplied.

In the third state in which the viscosity is increased from the second state, the liquid of the increased viscosity may be appropriately ejected when the first flushing signal is supplied the third number of times which is larger than the second number of times.

In a third mode which is a concrete example of the second mode, a pressure change caused by the micro vibration signal when the thickening determination section determines that the thickening state of the liquid included in the nozzle is the third state is larger than a pressure change caused by the micro vibration signal when the thickening determination section determines that the thickening state of the liquid included in the nozzle is the second state.

In the third state in which the viscosity is increased from the second state, the pressure change caused by the micro vibration signal is increased to be larger than the second state, and therefore, a local thickening state in the vicinity of the meniscus may be improved.

In a fourth mode which is a concrete example of the second mode or the third mode, when the thickening determination section determines that the thickening state of the liquid included in the nozzle is a state between the second state and the third state, the micro vibration signal is supplied to the driving element, the second flushing signal is supplied to the driving element the first number of times after the micro vibration signal is supplied, and the first flushing signal is supplied to the driving element a number of times which is larger than the second number of times and smaller than the third number of times after the second flushing signal is supplied.

In the state between the second state and the third state, the liquid having the increased viscosity is larger than the second state and smaller than the third state. Accordingly, the number of times the first flushing signal is supplied is also larger than the second number of times and smaller than the third number of times so that the liquid having the increased viscosity may be appropriately ejected.

In a fifth mode which is a concrete example of one of the first mode to the fourth mode, when the thickening determination section determines that the thickening state of the liquid included in the nozzle is a fourth state between the first state and the second state, the micro vibration signal is not supplied to the driving element, the second flushing signal is supplied to the driving element the first number of times, and the first flushing signal is supplied to the driving element a fourth number of times which is smaller than the second number of times after the second flushing signal is supplied.

In the fourth state between the first state and the second state, the liquid having the increased viscosity is larger than the first state and smaller than the second state. Accordingly, the number of times the first flushing signal is supplied is also smaller than the second number of times in the second state so that the liquid having the increased viscosity may be appropriately ejected.

In a sixth mode which is a concrete example of the fifth mode, when the thickening determination section determines that the thickening state of the liquid included in the nozzle is a fifth state between the fourth state and the second state, the micro vibration signal is not supplied to the driving element, the second flushing signal is supplied to the driving element the first number of times, and the first flushing signal is supplied to the driving element a fifth number of times which is larger than the fourth number of times and smaller than the second number of times after the second flushing signal is supplied.

In a seventh mode which is a concrete example of one of the first mode to the sixth mode, an amplitude of the meniscus of the nozzle when the second flushing signal is supplied to the driving element is larger than an amplitude of the meniscus of the nozzle when the first flushing signal is supplied to the driving element.

Since the amplitude of the second flushing signal is larger than the amplitude of the first flushing signal, the liquid may be ejected by the second flushing signal even in a thickening state in which the viscosity is increased in the vicinity of the meniscus and the liquid may not be ejected by the first flushing signal.

A liquid ejecting apparatus according to a preferred eighth mode includes a liquid ejecting section including a nozzle ejecting liquid, a pressure chamber communicated with the nozzle, and a driving element applying a pressure change to the liquid included in the pressure chamber, a driving signal generation section configured to generate a micro vibration signal which is supplied to the driving element and which applies a pressure change to such an extent that the liquid is not ejected from the nozzle, a first flushing signal which is supplied to the driving element and which applies a pressure change to the liquid included in the pressure chamber to such an extent that the liquid is ejected from the nozzle, and a second flushing signal which is supplied to the driving element and which applies a pressure change to the liquid included in the pressure chamber to such an extent that the liquid is ejected from the nozzle, a driving circuit configured to supply a signal generated by the driving signal generation section to the driving element, and a thickening determination section configured to determine a thickening state of the liquid included in the nozzle. The pressure change by the second flushing signal is larger than the pressure change by the first flushing signal. An amount of liquid ejected from the nozzle when the first flushing signal is supplied to the driving element once is larger than an amount of liquid ejected from the nozzle when the second flushing signal is supplied to the driving element once. When the thickening determination section determines that a thickening state of the liquid included in the nozzle is a first state, the micro vibration signal is not supplied to the driving element and the second flushing signal is supplied to the driving element a first number of times. When the thickening determination section determines that the thickening state of the liquid included in the nozzle is a second state in which viscosity of the liquid is higher than viscosity of the liquid in the first state, the micro vibration signal is supplied to the driving element, the second flushing signal is supplied to the driving element the first number of times after the micro vibration signal is supplied, and the first flushing signal is supplied to the driving element a second number of times after the second flushing signal is supplied.

What is claimed is:

1. A method for driving a liquid ejecting apparatus, the liquid ejecting apparatus comprising:

a liquid ejecting section including a nozzle ejecting liquid, a pressure chamber communicated with the nozzle, and a driving element applying a pressure change to the liquid in the pressure chamber;

a driving signal generation section configured to generate a micro vibration signal which causes the driving element to apply a pressure change in liquid in the pressure chamber, in an extent in which the liquid is not ejected from the nozzle, when the micro vibration signal is applied to the driving element, a first flushing signal which causes the driving element to apply a pressure change in liquid in the pressure chamber, in an extent in which the liquid is ejected from the nozzle, the first flushing signal is applied to the driving element, and a second flushing signal which causes the driving element to apply a pressure change in liquid in the pressure chamber, in an extent in which the liquid is ejected from the nozzle; and a thickening determination section configured to determine a thickening state of the liquid in the nozzle, wherein the pressure change by the second flushing signal is larger than the pressure change by the first flushing signal, an amount of liquid ejected from the nozzle when the first flushing signal is supplied to the driving element once is larger than an amount of liquid ejected from the nozzle when the second flushing signal is supplied to the driving element once, the method comprising:

when the thickening determination section determines that a thickening state of the liquid in the nozzle is a first state, supplying the second flushing signal to the driving element a first number of times without supplying the micro vibration signal to the driving element and when the thickening determination section determines that the thickening state of the liquid in the nozzle is a second state in which viscosity of the liquid is higher than viscosity of the liquid in the first state, supplying the second flushing signal to the driving element the first number of times after the micro vibration signal is supplied to the driving element, and supplying the first flushing signal to the driving element a second number of times after the second flushing signal is supplied to the driving element the first number of times.

2. The method for driving the liquid ejecting apparatus according to claim 1, the method further comprising:

when the thickening determination section determines that the thickening state of the liquid in the nozzle is a third state in which viscosity of the liquid is higher than the viscosity in the second state, applying the second flushing signal to the driving element the first number of times after the micro vibration signal is supplied to the driving element, and supplying the first flushing signal to the driving element a third number of times which is larger than the second number of times after the second flushing signal is supplied the first number of times.

3. The method for driving the liquid ejecting apparatus according to claim 2, wherein a pressure change caused by the micro vibration signal when the thickening determination section determines that the thickening state of the liquid in the nozzle is the third state is larger than a pressure change caused by the micro vibration signal when the thickening determination section determines that the thickening state of the liquid in the nozzle is the second state.

4. The method for driving the liquid ejecting apparatus according to claim 2, the method further comprising:

when the thickening determination section determines that the thickening state of the liquid in the nozzle is a state between the second state and the third state, applying the second flushing signal to the driving element the first number of times after the micro vibration signal is supplied to the driving element, and applying the first flushing signal to the driving element a number of times which is larger than the second number of times and smaller than the third number of times after the second flushing signal is supplied to the driving element the first number of times.

5. The method for driving the liquid ejecting apparatus according to claim 1, the method further comprising:

when the thickening determination section determines that the thickening state of the liquid in the nozzle is a fourth state between the first state and the second state, applying the second flushing signal to the driving element the first number of times without applying the micro vibration signal to the driving signal, and applying the first flushing signal to the driving element a fourth number of times which is smaller than the second number of times after the second flushing signal is supplied to the driving element the first number of times.

6. The method for driving the liquid ejecting apparatus according to claim 5, the method further comprising:

when the thickening determination section determines that the thickening state of the liquid in the nozzle is a fifth state between the fourth state and the second state, applying the second flushing signal to the driving element the first number of times without applying the micro vibration signal to the driving signal, and applying the first flushing signal to the driving element a fifth number of times which is larger than the fourth number of times and smaller than the second number of times after the second flushing signal is supplied to the driving element the first number of times.

7. The method for driving the liquid ejecting apparatus according to claim 1, wherein an amplitude of the meniscus in the nozzle when the second flushing signal is supplied to the driving element is larger than an amplitude of the meniscus in the nozzle when the first flushing signal is supplied to the driving element.

8. A liquid ejecting apparatus comprising:

a liquid ejecting section including a nozzle ejecting liquid, a pressure chamber communicated with the nozzle, and a driving element applying a pressure change to the liquid in the pressure chamber;

a driving signal generation section configured to generate signals including a micro vibration signal which causes the driving element to apply a pressure change in liquid in the pressure chamber, in an extent in which the liquid is not ejected from the nozzle, when the micro vibration signal is applied to the driving element, a first flushing signal causes the driving element to apply a pressure change in liquid in the pressure chamber, in an extent in which the liquid is ejected from the nozzle, the first flushing signal is applied to the driving element, and a second flushing signal which causes the driving element to apply a pressure change in liquid in the pressure chamber, in an extent in which the liquid is ejected from the nozzle;

a driving circuit configured to supply the signals generated by the driving signal generation section to the driving element; and a thickening determination section configured to determine a thickening state of the liquid in the nozzle, wherein the pressure change by the second flushing signal is larger than the pressure change by the first flushing signal, an amount of liquid ejected from the nozzle when the first flushing signal is supplied to the driving element once is larger than an amount of liquid ejected from the nozzle when the second flushing signal is supplied to the driving element once, when the thickening determination section determines that a thickening state of the liquid in the nozzle is a first state, the driving circuit supplies the second flushing signal to the driving element a first number of times without supplying the micro vibration signal to the driving element, and when the thickening determination section determines that the thickening state of the liquid in the nozzle is a second state in which viscosity of the liquid is higher than viscosity of the liquid in the first state, the driving circuit supplies the second flushing signal to the driving element the first number of times after the micro vibration signal is supplied to the driving element, and supplies the first flushing signal to the driving element a second number of times after the second flushing signal is supplied to the driving element the first number of times.

* * * * *